United States Patent [19]

Van Slooten

[11] Patent Number: 4,628,601

[45] Date of Patent: Dec. 16, 1986

[54] HAIR CUTTING APPLIANCE

[76] Inventor: Kevin D. Van Slooten, Rte. 2, Box 202, Hettinger, N. Dak. 58639

[21] Appl. No.: 809,211

[22] Filed: Dec. 16, 1985

[51] Int. Cl.[4] ..... B26B 19/44; B26B 19/20

[52] U.S. Cl. ..... 30/133; 30/201

[58] Field of Search ..... 30/133, 201, 41.5

[56] References Cited

U.S. PATENT DOCUMENTS

| | | | |
|---|---|---|---|
| 1,331,218 | 2/1920 | Severson . | |
| 1,506,139 | 8/1924 | Severson | 30/133 |
| 2,914,849 | 12/1959 | Watkins | 30/133 |
| 3,302,286 | 2/1967 | Zucker | 30/133 |
| 3,331,130 | 7/1967 | Ligon | 30/133 |
| 3,368,277 | 2/1968 | Vevea | 30/133 |
| 3,979,825 | 9/1976 | Baumann | 30/133 |
| 4,000,562 | 1/1977 | Alevras | 30/133 |
| 4,005,526 | 2/1977 | Clay | 30/133 |
| 4,030,196 | 6/1977 | Koiwa et al. | 30/133 |
| 4,150,483 | 4/1979 | Kanazawa | 30/133 |
| 4,216,581 | 8/1980 | Van Slooten | 30/133 |

*Primary Examiner*—Jimmy C. Peters

*Attorney, Agent, or Firm*—Kinney & Lange

[57] ABSTRACT

A hair cutting appliance includes a vacuum driven hair cutting shear mounted in a hair handling device so that hair being driven through the turbine operated shear draws uncut hair down a tunnel in the hair handling device to be severed by the blades of the shear. A hair deflector is positioned in the tunnel to move rapidly between a first position in clearing relationship to the shear blades and a second position wherein the deflector forces the uncut hair in the tunnel down into the shear blades where it is severed.

8 Claims, 5 Drawing Figures

HAIR CUTTING APPLIANCE

BACKGROUND OF THE INVENTION

1. Field of the Invention

This invention has relation to hair cutting appliances for automatically cutting substantially all of the hair extending from the head of a customer to a uniform length and for automatically disposing of the cut-off hair ends by use of a vacuum.

2. Description of the Prior Art

It is known to use a suction tube to extend the hair from the scalp for the purpose of cutting it at a desired length. See U.S. Pat. No. 1,331,218 to Severson, granted in February of 1920, U.S. Pat. No. 4,000,562 to Alevras, granted in January of 1977; U.S. Pat. No. 4,005,526 to Clay, granted in February of 1977; and U.S. Pat. No. 4,030,196 to Koiwa et al, granted in June of 1977.

The present applicant was granted U.S. Pat. No. 4,216,581 in August of 1980, and this patent teaches a novel and effective structure for cutting hair to a predetermined length. The prior art set out in that patent and in the Office Actions and amendments in the file wrapper of that patent form part of the prior art in this application and are incorporated herein by this reference.

The present invention incorporates a modified version of a vacuum-powered shear sold under the trademark KIRBY as a TURBO GROOM MODEL.

The structure of the present invention discloses an even more facile manner of accomplishing its objects than is taught by the prior art.

Neither the inventor nor those in privity with him are aware of any prior art which is closer than that referred to or discussed above, or which anticipates the claims herein.

SUMMARY OF THE INVENTION

A hair cutting appliance of the invention includes a hair handling device including a tunnel which provides a longitudinally extending hair handling passageway. Part of that passageway constitutes an uncut hair passageway. The tunnel has a forward intake portion and a rearward exit portion, and the uncut hair passageway is partially defined by mutually parallel flat top and flat bottom tunnel wall portions extending in direction from the tunnel's forward intake portion toward its rearward exit portion. The flat bottom tunnel wall portion terminates between the intake and exit portions of the hair handling passageway on a line transverse to the longitudinal axis of the hair handling passageway. A hair cutting shear is fixedly positioned with respect to the tunnel of the hair handling device to have a plurality of its shear blade cutting teeth generally linearly disposed in a straight line parallel to and immediately adjacent the line of termination of the flat bottom tunnel wall portion of the hair handling device. These cutting teeth extend from outside of the hair handling passageway through the plane of the flat bottom tunnel wall portion and into the hair handling passageway.

The hair cutting appliance includes a body having a first cut hair receiving port adjacent the line of the shear blade cutting teeth and open to the rearward exit portion of the tunnel and a second cut hair discharge port spaced from the first port. The body of the hair cutting appliance is provided with a cut hair collecting passageway which is open between these ports. A means for drawing a vacuum is attached to the cut hair discharge port and draws air through the hair handling passageway including the uncut hair passageway and also through the cut hair collecting passageway.

The hair handling device includes a hair deflector which is pivotally mounted at its first innermost end portion inside of the tunnel on an axis parallel to the linear line of the shear blades, the innermost end portion of the deflector being in adjacent relationship to the top tunnel wall portion. The deflector means is partially defined by a forwardly facing deflector surface and a rearwardly facing deflector surface and by a connecting surface connecting the outermost end portions of the forwardly and rearwardly facing surfaces.

In one form of the invention, as shown, this outermost connecting surface is constituted as a notch. Means is provided for moving this hair deflector rapidly between first and second positions, the first position being separated from the shear blades to allow uncut hair to pass through the uncut hair passageway and to have position over the line of shear blades, and a second position wherein the deflector causes the uncut hair so positioned to be forced down into the line of the shear blades to be severed. In the form of the invention as shown, with this connecting portion actually being in the form of a notch, the edges of the notch encompass the shear blades to positively move the uncut hair down into the blades.

While the shear blades themselves and the hair deflector can be driven by any one of a number of independent or combined drive means to accomplish the purposes of the invention, in the form of the invention as shown, a turbine wheel is situated in the cut hair receiving passageway in the main body of the hair cutting appliance and effective linkages are provided to drive the shear blades and also to drive the hair deflector.

Using a known shear which is designed to be driven by a means for drawing a vacuum and which attempts to capture the cut hair ends using that same vacuum, this hair handling device of the present invention has used this same motive power to positively force the uncut hair down into the shear blades. The appliance of the invention thereby eliminates the necessity for using any connection with electrical energy which might unduly complicate the handling of the appliance and which always introduces, on some level, a concern for electrical shock and short circuit.

DETAILED DESCRIPTION OF THE PREFERRED EMBODIMENTS

Figure 1:
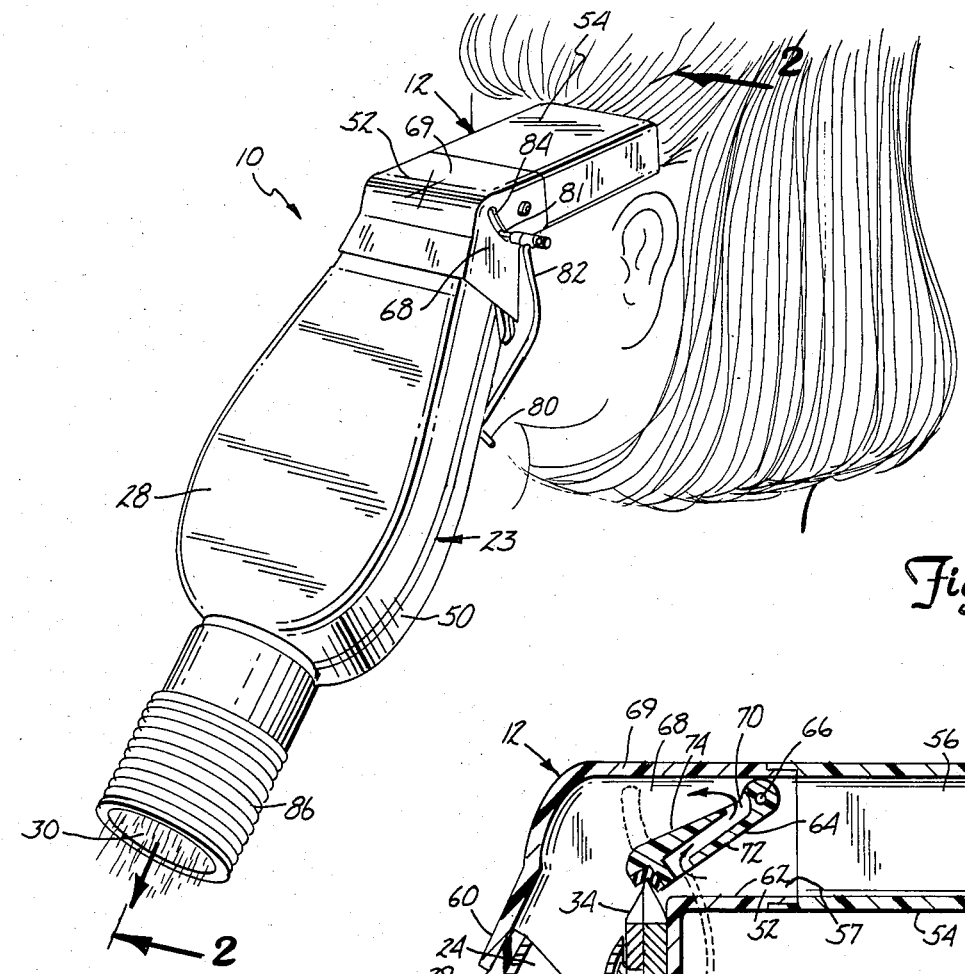
FIG. 1 is a perspective view of a hair cutting appliance made according to the present invention shown in relationship to the head of a person receiving a haircut with it.

A hair cutting appliance 10 includes a hair handling device 12 mounted to a hair cutting shear 14. The hair cutting shear 14 is a modified version of a vacuum-powered shear sold under the trademark KIRBY as a Turbo Groom Model and includes a die cast main frame 16, and a turbine wheel 18 rotatably mounted on the frame 16 and including impeller blades 20. The appliance also includes a die cast turbine air drive conduit 22. Conduit 22 is provided with a first turbine air intake port 24, which will also be termed a first cut hair receiving port 24, and is also provided with a turbine wheel drive port 26. Turbine wheel drive port 26 is so designed as to cause air sucked through the air drive conduit 22 to impinge on the impeller blades 20 in direction to cause the turbine wheel 18 to rotate. As shown, the conduit 22 is integral with main frame 16 and together they form essential parts of a hair appliance body 23.

A front hair cutting shear casing 28 normally snap fastens to main frame 16 to combine with the turbine air drive conduit 22 and that frame, as a part of appliance body 23, to provide a turbine air drive passageway 29 also called cut hair collecting passageway 29. Passageway 29 includes a second turbine air discharge port 30 which is also called herein the second cut hair discharge port 30.

A means for drawing a vacuum and for collecting cut hair will be attached to discharge port 30. This means can be of any usual or preferred construction, such, for example, as a conventional vacuum cleaner (not shown) and its hose 86.

Figure 2:
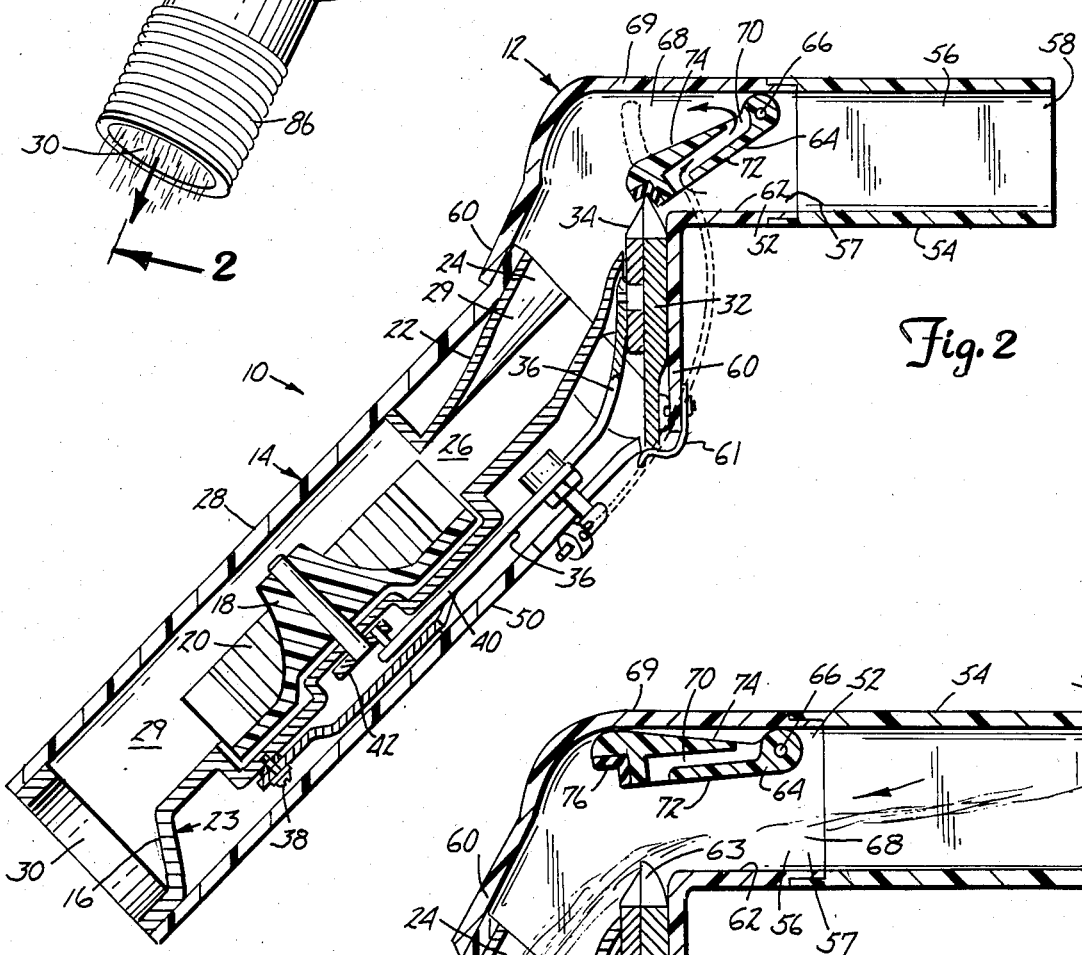
FIG. 2 is an enlarged vertical sectional view taken generally on the line 2—2 in FIG. 1.
Figure 4:
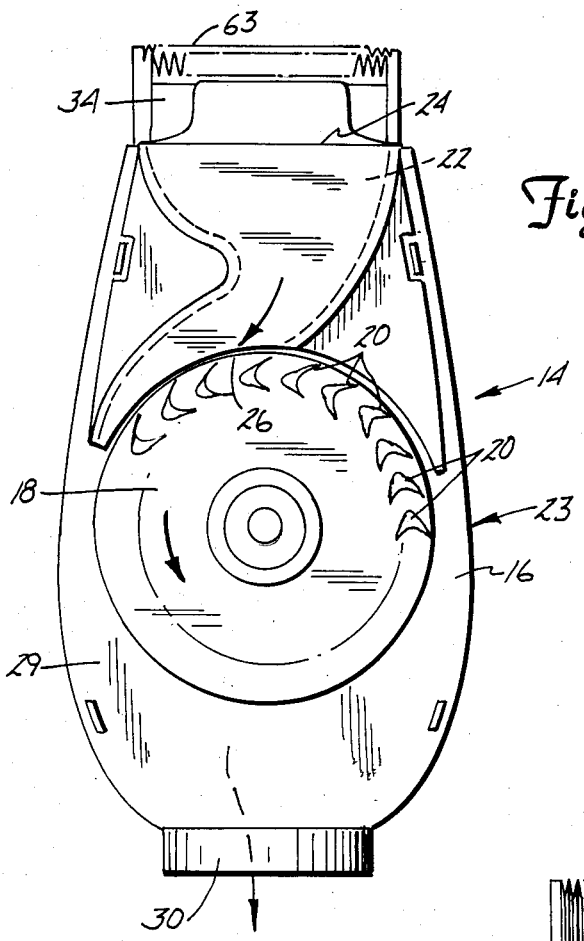
FIG. 4 is a front elevational view of a hair cutting shear making up a part of the hair cutting appliance of the invention with a front casing removed.
Figure 5:
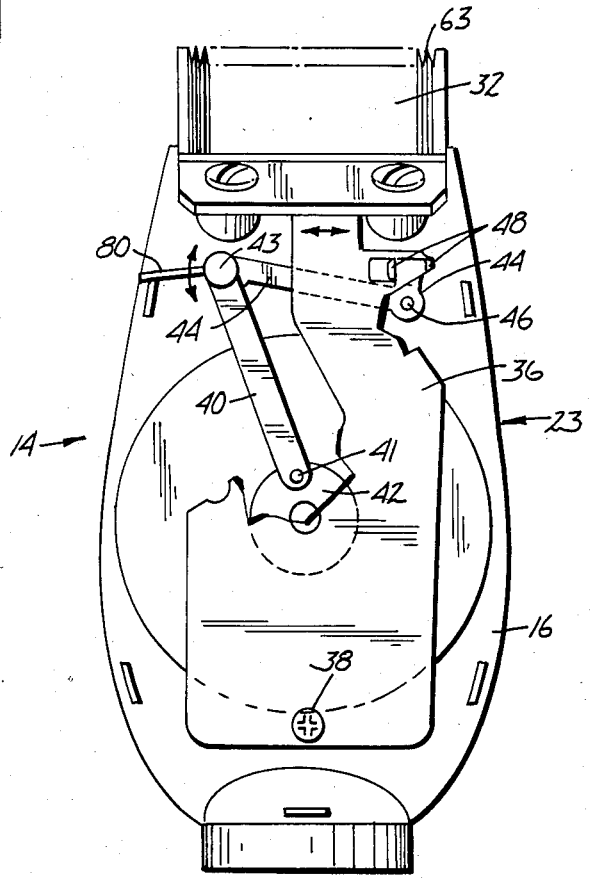
FIG. 5 is a rear elevational view of the hair cutting shear of FIG. 4 with a rear casing removed therefrom.

As best seen in FIGS. 2 and 5, a fixed shear blade 32 is fixedly but replaceably mounted with respect to the main frame 16 of the hair cutting shear 14. A moving shear blade 34 (see FIG. 4) is replaceable but fixably mounted to move with an upper end portion of a wobble plate 36. As best seen in FIG. 5, this wobble plate 36 is pivotably mounted at its lower end portion as at 38 to the main hair cutting shear frame 16 so that movement of this shear drive wobble plate from side to side causes movement of the moving shear blade 34 with respect to fixed shear blade 32, severing any hair which comes between the teeth of these blades.

The wobble plate 36 is driven back and forth by a turbine wheel drive link 40 which is pivotably mounted as at 41 to a hub 42 of the turbine wheel 18. Drive link 40 is pivotably connected at 43 to a long arm of a wobble plate crank 44. This crank 44 is pivotably mounted to the hair cutting shear frame 16 as at 46. A short arm of the crank 44 extends away from pivot point 46 in direction toward the shear blades, and is "trapped" between two wobble plate ears 48,48, extending integrally and perpendicularly outwardly from the wobble plate 36. This linkage drive mechanism transfers the rotary motion of the turbine wheel 18 into motion generally longitudinally of the passageway 29 at the outer end of the long arm of the crank 44, and this is transformed by the short arm of crank 44 into a very short stroke of motion of the moving shear blade 34 transverse to the longitudinal movement of air through the appliance 10.

A back hair cutting shear casing 50 normally snap fastens to the main shear frame 16 to cover the drive mechanism just described, and this casing 50 is cut away at appropriate places to accommodate the means for driving the working parts of the hair handling device 12 which will now be described.

The hair handling device 12 includes an uncut hair conduit or tunnel 52 and a sleeve 54 frictionally mounted on the tunnel 52. Together the tunnel and sleeve provide a hair handling passageway 56. Passageway 56 is partially defined by, and tunnel 52 includes an uncut hair passageway 57. A flat bottom tunnel wall 62, forming part of uncut hair passageway 57, terminates adjacent the working ends of shear blades 32 and 34. Tunnel 52 also includes parallel spaced-apart tunnel side walls 68,68 integral with bottom wall 62 and a top tunnel wall 69 integral with the side walls. The length of the tunnel, from the shear blades toward the sleeve 54, plus the length of the sleeve itself determines the minimum hair length which can be cut when the forward end of the sleeve rests against the head of a person receiving the haircut. When shorter or longer haircut lengths are desired, shorter or longer sleeves 54 will be used. When very short haircuts are desired, the tunnel 52 can be used without a sleeve.

In the form of the invention as shown, hair handling passageway 56 has a forward intake portion 58 and a downwardly extending rearward exit skirt portion 60. Means fixedly positions the hair handling device 12 including the tunnel 52 with respect to the fixed and moving shear blades 32 and 34. As here shown, this means includes the downwardly extending skirt portion 60 of the tunnel 52 and a spring clip 61 riveted to the skirt 60 and snapped over the lower end of the fixed shear blade 32.

The fixed and moving shear blades 32 and 34 together present a line 63 of linearly disposed shear blade cutting teeth situated in normal, transverse relationship to the longitudinal axis of the tunnel 52 and of the hair handling passageway 56. These shear blade cutting teeth extend from outside of the tunnel, upwardly past and adjacent to the bottom tunnel wall 62.

Figure 3:
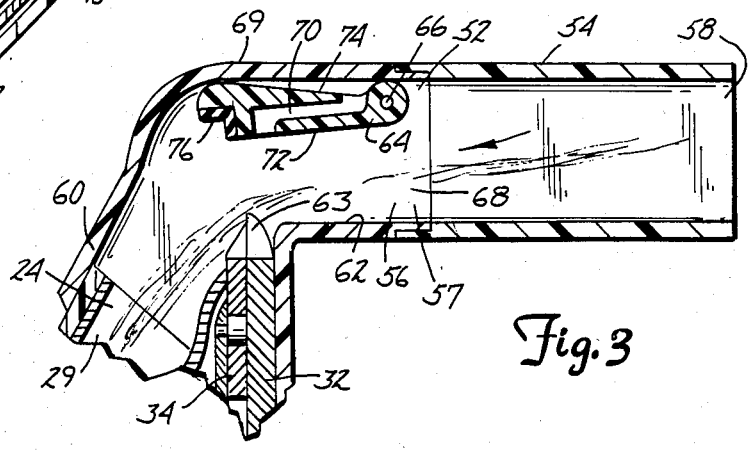
FIG. 3 is a fragmentary, slightly enlarged, vertical sectional view of a portion of the appliance as seen in FIG. 2 but with the parts differently positioned.

A first innermost end portion of an uncut hair deflector 64 is pivotably mounted as at 66 to and between the side walls 68,68 on an axis parallel to the linear line 63 defined by the cutting teeth. The deflector 64 extends from wall 68 to wall 68, and is partially defined by a forwardly facing deflector surface 72 and a rearwardly facing surface 74. As seen in FIGS. 2 and 3, a pressure relief passage 70 is open through the deflector from an outer end portion of the forward deflector surface 72 to an inner end portion of the rearward surface 74. A connecting surface is provided at a second outermost end portion of the deflector 64. As shown, this surface takes the form of a notch 76 situated to encompass the outer ends of the line 63 of the shear blade cutting teeth during each complete cycle of operation of the appliance 10.

In operation, the deflector 64 moves between a first position, as seen in FIG. 3, where its forwardly facing deflector surface 72 lies in clearing relation to the cutting teeth of the shear blades to allow uncut hair to be carried down passageway 56 and over the line 63 of shear blade cutting teeth; and a second position as seen in FIG. 2 where the edges of notch 76 have moved any uncut hair down into the line of teeth to be cut off by them.

Any unsevered hair bridging both edges of notch 76 will, under the influence of air flow through hair handling passageway 56, lie in a relatively straight line across the notch edges, and so will be carried very easily deep into the cutting teeth 63.

Similarly, hair not long enough to reach the "down stream" notch edge will also tend to be held in alignment with the longitudinal axis of the hair handling passageway 56 by air flow in that passageway. This hair will also be easily carried down into the teeth of the shear blades 32 and 34 to be severed. At the point of operation as shown in FIG. 2, the flow of air through tunnel 52 between the notch 76 and bottom tunnel wall 62 will be momentarily substantially impeded, and air flow will proceed instead through pressure relief passage 70 in deflector 64. Thus, as hair is severed from a person's head by the line 63 of cutting teeth, there is at all times sufficient air flow to carry that cut hair through first cut hair receiving port 24, turbine wheel drive port 26, turbine wheel 18, second cut hair discharge port 30 and vacuum cleaner hose 86 to the means for drawing a vacuum (not shown).

In the form of the invention as shown, the means to move the deflector 64 between its first and second positions is linked to the means for driving the moving blade 34 transversely with respect to the longitudinal axis of the hair handling passageway 56. Appropriate openings (not specifically shown) are provided in the back shear casing 50 to accommodate a hair deflector driving pin 80, attached as at 43 to the point where the turbine wheel drive link 40 is pivoted to wobble plate crank arm 44, as pin 80 extends outwardly through casing 50. This positioning of parts is best seen in FIG. 5. The direction of the movement of this common point of connection 43 is indicated in FIG. 5 by the double arrows adjacent that point.

As best seen in FIGS. 1, 2 and 3, a hair deflector driven pin 81 extends outwardly from the deflector 64 through an appropriate slot 84 in the tunnel 52. Deflector drive pin 80 and driven pin 81 are operably connected by a deflector drive link 82.

As seen in FIG. 1, vacuum cleaner hose 86 will be attached to the cut hair discharge port or turbine discharge port 30 when it is desired to use the hair cutting appliance to cut hair. With the vacuum cleaner (not shown) turned on to develop a suction in the vacuum cleaner hose, the deflector 64 will move between its first and second positions every time the turbine wheel 18 makes one-half of a revolution. Therefore, each time the moving shear blade 34 completes a cycle from one side to the other and back, the deflector 64 will have moved from one position to the other and back.

With each cycle, hair will be drawn in through the tunnel 52, rapidly deflected down into the line 63 of teeth and cut off. The cut hair portions will be carried down into the cut hair collecting passageway 29 by the flow of air through the tunnel and out through cut hair discharge port 30.

Although the present invention has been described with reference to preferred embodiments, workers skilled in the art will recognize that changes may be made in form and detail without departing from the spirit and scope of the invention.

What is claimed is:

1. A hair cutting appliance for use with a means for drawing a vacuum, said appliance including:

A. a hair handling device including a tunnel providing a longitudinally extending hair handling passageway including an uncut hair passageway, said tunnel having a forward intake portion and a rearward exit portion, the uncut hair passageway being partially defined by mutually parallel top tunnel wall and bottom tunnel wall portions located between forward intake portion and the rearward exit portion of the tunnel, with a downstream edge of the bottom tunnel wall portion terminating intermediate the intake and exit portions of the hair handling passageway on a line normal to the longitudinal axis of the hair handling passageway;

B. a hair cutting shear fixedly positioned with respect to the hair handling device to have a plurality of its shear blade cutting teeth generally linearly disposed in a straight line parallel to and immediately adjacent the line of termination of the flat bottom tunnel wall portion, said cutting teeth extending from outside the hair handling passageway through the plane of the bottom tunnel wall portion into said passageway;

C. said hair cutting appliance having a body providing a first cut hair receiving port downstream of the line of the shear blade cutting teeth and open to the rearward exit portion of said tunnel and a second cut hair discharge port spaced from the first port, the appliance body being provided with a cut hair collecting passageway open between said ports;

D. means for attaching said means for drawing a vacuum to said cut hair discharge port;

E. wherein said hair handling device includes a hair deflector pivotally mounted at its first innermost end portion in the tunnel on an axis parallel to the linear line of the shear blades and in adjacent relation to said top tunnel wall portion, said deflector means being partially defined by a forwardly facing deflector surface, a rearwardly facing deflector surface and a connecting surface extending between the forwardly and rearwardly facing surfaces at a second outermost end portion of the hair deflector, the deflector being movable between a first position wherein it lies in clearing relation to the line of cutting teeth of the shear blades and a second position wherein the deflector connecting surface and the outermost end portion of the forwardly facing surface of the deflector are in sufficiently close relationship with respect to the line of shear blades to cause uncut hair in the uncut hair passageway to be deflected into the operating path of the shear cutting blades; and F. drive means to move said deflector between said first and second positions and to drive said shear when said means for drawing a vacuum is operable to draw air through said hair handling passageway and said cut hair collecting passageway.

2. The hair cutting appliance of claim 1 wherein:

G. an air driven turbine wheel including impeller blades is rotatably mounted with respect to the hair cutting appliance on a turbine wheel driven shaft to lie in operational relationship to the cut hair collecting passageway between the first cut hair receiving port and the second cut hair discharge port;

H. hair deflector drive means is operably connected between the turbine wheel and the hair deflector to cause the hair deflector to move between said first and second positions responsive to rotation of said turbine wheel.

3. The hair cutting appliance of claim 2 wherein:

I. shear blade drive means is operably connected between at least one shear blade and said turbine wheel to cause at least one of said shear blades to move with respect to the other responsive to rotation of said turbine wheel.

4. The hair cutting appliance of claim 3 wherein:

J. said deflector is provided with a pressure relief passage therethrough open from an outer end portion of the forward deflector surface to an inner end portion of the rearward deflector surface.

5. A hair cutting appliance for use with a means for drawing a vacuum, said appliance including:

A. a hair handling device including a tunnel providing a longitudinally extending hair handling passageway including an uncut hair passageway, said tunnel having a forward intake portion and a rearward exit portion, the uncut hair passageway being partially defined by mutually parallel top tunnel wall and flat bottom tunnel wall portions located between the forward intake portion and the rearward exit portion of the tunnel with a downstream edge of the bottom tunnel wall portion terminating intermediate the intake and exit portions of the hair handling passageway on a line normal to the longitudinal axis of the hair handling passageway;

B. a hair cutting shear fixedly positioned with respect to the hair handling device to have a plurality of its shear blade cutting teeth generally linearly disposed in a straight line parallel to and immediately adjacent the line of termination of the flat bottom tunnel wall portion, said cutting teeth extending from outside the hair handling passageway through the plane of the bottom tunnel wall portion into said passageway;

C. said hair cutting appliance having a body providing a first cut hair receiving port downstream of the line of the shear blade cutting teeth and open to the rearward exit portion of said tunnel and a second cut hair discharge port spaced from the first port, the appliance body being provided with a cut hair collecting passageway open between said ports;

D. means for attaching said means for drawing a vacuum to said cut hair discharge port;

E. said hair handling device including a hair deflector pivotally mounted at its first innermost end portion in the tunnel on an axis parallel to the linear line of the shear blades and in adjacent relation to said top tunnel wall portion, said deflector being partially defined by a forwardly facing deflector surface, a rearwardly facing surface spaced from the forwardly facing surface and a notch disposed between said forwardly and rearwardly facing surfaces at a second outermost end portion of the hair deflector, the deflector being movable between a first position wherein it lies in clearing relation to the line of cutting teeth of the shear blades and a second position wherein the edges of the notch have moved into encompassing relation to the line of shear blade cutting teeth; and F. drive means to move said deflector between said first and second positions and to drive said shear when said means for drawing a vacuum is operable to draw air through said hair handling passageway and said cut hair collecting passageway.

6. The hair cutting appliance of claim 5 wherein:

G. said deflector is provided with a pressure relief passage therethrough open from an outer end portion of the forward deflector surface to an inner end portion of the rearward deflector surface.

7. The hair cutting appliance of claim 5 wherein:

G. an air driven turbine wheel including impeller blades is rotatably mounted with respect to the hair cutting appliance on a turbine wheel driven shaft to lie in operational relationship to the cut hair collecting passageway between the first cut hair receiving port and the second cut hair discharge port;

H. hair deflector drive means is operably connected between the turbine wheel and the hair deflector to cause the hair deflector to move between said first and second positions responsive to rotation of said turbine wheel.

8. The hair cutting appliance of claim 7 wherein:

I. shear blade drive means is operably connected between at least one shear blade and said turbine wheel to cause at least one of said shear blades to move with respect to the other responsive to rotation of said turbine wheel.

* * * * *